US009097252B2

(12) United States Patent
Schofield et al.

(10) Patent No.: US 9,097,252 B2
(45) Date of Patent: Aug. 4, 2015

(54) SCROLL PUMP INCLUDING DRIVE SHAFT EXTENDING THROUGH FIXED SCROLL

(75) Inventors: Nigel Paul Schofield, Horsham (GB); Michael Chung Kau Liu, Horsham (GB)

(73) Assignee: Edwards Limited, Crawley (GB)

( * ) Notice: Subject to any disclaimer, the term of this patent is extended or adjusted under 35 U.S.C. 154(b) by 147 days.

(21) Appl. No.: 13/641,937

(22) PCT Filed: Apr. 7, 2011

(86) PCT No.: PCT/GB2011/050688

§ 371 (c)(1),
(2), (4) Date: Oct. 18, 2012

(87) PCT Pub. No.: WO2011/135324

PCT Pub. Date: Nov. 3, 2011

(65) Prior Publication Data

US 2013/0039791 A1 Feb. 14, 2013

(30) Foreign Application Priority Data

Apr. 28, 2010 (GB) ..... 1007028.2

(51) Int. Cl.
*F04C 18/02* (2006.01)
*F01C 17/06* (2006.01)
(Continued)

(52) U.S. Cl.
CPC ..... *F04C 18/0215* (2013.01); *F01C 17/066* (2013.01); *F01C 21/007* (2013.01);
(Continued)

(58) Field of Classification Search
CPC ..... F01C 17/066; F01C 21/007; F01C 21/02; F04C 25/02; F04C 18/02; F04C 2240/807
USPC ..... 418/55.3, 55.2, 55.4
See application file for complete search history.

(56) References Cited

U.S. PATENT DOCUMENTS 4,371,323 A * 2/1983 Fischer et al. ..... 418/55.3
5,743,719 A * 4/1998 Haga et al. ..... 418/15
(Continued)

FOREIGN PATENT DOCUMENTS

EP 1333179 A2 8/2006
GB 2054045 A 2/1981
(Continued)

OTHER PUBLICATIONS

English summary of and original JP Official Action dated Oct. 8, 2014 in counterpart JP Application No. 2013-506741, 4 pgs.
(Continued)

*Primary Examiner* — Thomas Denion
*Assistant Examiner* — Xiaoting Hu
(74) *Attorney, Agent, or Firm* — Shumaker & Sieffert, P.A.

(57) ABSTRACT

A scroll pump includes a pump housing, a drive shaft having a concentric shaft portion and an eccentric shaft portion connected to an orbiting scroll. The shaft is driven by a motor so that rotation of the shaft imparts an orbiting motion to the orbiting scroll relative to a fixed scroll for pumping fluid between a pump inlet and a pump outlet of the compressor. The fixed scroll has an opening through which the shaft extends and is connected to the orbiting scroll on an opposing side of the fixed scroll to the motor. An anti-rotation device is located in the high vacuum region for resisting rotation of the orbiting scroll and allowing said orbiting motion, and a bearing arrangement for supporting rotation of the concentric shaft portion and eccentric shaft portion is located in tile low vacuum region.

17 Claims, 4 Drawing Sheets

(51) Int. Cl.

| | |
|---|---|
| ***F01C 21/00*** | (2006.01) |
| ***F01C 21/02*** | (2006.01) |
| ***F04C 25/02*** | (2006.01) |

(52) U.S. Cl.

CPC ..... *F01C 21/02* (2013.01); *F04C 18/0253* (2013.01); *F04C 25/02* (2013.01); *F04C 2240/807* (2013.01); *F04C 2270/12* (2013.01)

(56) References Cited

U.S. PATENT DOCUMENTS

| | | | | |
|---|---|---|---|---|
| 5,775,893 | A * | 7/1998 | Takao et al. | 418/55.2 |
| 5,855,473 | A * | 1/1999 | Liepert | 418/5 |
| 5,934,890 | A * | 8/1999 | Mihara et al. | 418/55.3 |
| 5,947,694 | A * | 9/1999 | Hablanian | 417/201 |
| 6,149,405 | A * | 11/2000 | Abe et al. | 417/420 |
| 7,645,130 | B2 * | 1/2010 | Sekiya et al. | 418/55.4 |
| 2004/0234405 | A1 * | 11/2004 | Tsuchiya | 418/55.3 |
| 2007/0212245 | A1 * | 9/2007 | Tsuchiya | 418/55.3 |
| 2008/0069713 | A1 * | 3/2008 | Ignatiev et al. | 418/55.3 |
| 2008/0124236 | A1 * | 5/2008 | Schofield | 418/55.1 |
| 2009/0180909 | A1 * | 7/2009 | Schofield et al. | 418/55.1 |

FOREIGN PATENT DOCUMENTS

| | | | |
|---|---|---|---|
| JP | 2002371977 | A | 12/2002 |
| WO | 2004072483 | A1 | 8/2004 |
| WO | 2006061559 | A2 | 6/2006 |
| WO | 2007080371 | A1 | 7/2007 |

OTHER PUBLICATIONS

English Translation of the First Office Action from counterpart Chinese Patent Application No. 201180021348.3, dated Oct. 27, 2014, 11 pp.

* cited by examiner

SCROLL PUMP INCLUDING DRIVE SHAFT EXTENDING THROUGH FIXED SCROLL

The present invention relates to a scroll pump, which is often referred to as a scroll compressor.

A prior art scroll compressor, or pump, 100 is shown in FIG. 3. The pump 100 comprises a pump housing 102 and a drive shaft 104 having an eccentric shaft portion 106. The shaft 104 is driven by a motor 108 and the eccentric shaft portion is connected to an orbiting scroll 110 so that during use rotation of the shaft imparts an orbiting motion to the orbiting scroll relative to a fixed scroll 112 for pumping fluid along a fluid flow path between a pump inlet 114 and pump outlet 116 of the compressor.

The radial clearances between the orbiting and fixed scrolls are accurately controlled so that lubricant is generally not required in the scroll arrangement. The axial clearances between the scrolls are sealed with tip seals. The arrangement means that a scroll pump is suitable for pumping a dry or clean environment such as a semi-conductor processing tools. However, the concentric shaft 104 and the eccentric portion 106 are supporting by bearings 118 and 120 which are typically lubricated. A bellows arrangement 122 is located on the orbiting scroll side of the scroll arrangement and isolates the bearings from the high vacuum region 124 at the inlet 114 from the region 126 containing the bearings which is typically at or close to atmosphere. In this way, the bellows arrangement prevents contamination of the high vacuum region 124 by lubricant and other contaminants. The bellows arrangement also acts to prevent rotation of the orbiting scroll but is sufficiently flexible to allow orbiting motion. A counter-weight 128 is provided for balancing the weight of the orbiting components of the pump.

In another scroll pump 150, illustrated in FIG. 4, instead of a bellows arrangement, an anti-rotation device 152 resists rotation of the orbiting scroll 110 relative to a fixed, or housing, part 154. The device 152 is fixed to the housing part and the orbiting scroll by fixing members 156 and flexes to allow orbiting motion of the orbiting scroll. However, without the bellows arrangement 122, lubricant from the bearings 118, 120 or motor 108 may leak into the flow path of pumped gases causing contamination, particularly due to the high pressure differential across the bearings from high vacuum to low vacuum. Accordingly, even though the anti-rotation device 152 is lubricant free, shaft seals 158, 160 must be provided to seal the bearings from the high vacuum region 124 of the pump. In view of the high pressure differential across the bearings, some leakage may still occur into the high vacuum region of the pump.

The present invention provides an improved scroll pump which at least in the example discussed in detail below is more compact than known scroll pumps.

The present invention provides a scroll pump comprising a pump housing, a drive shaft having a concentric shaft portion and an eccentric shaft portion connected to an orbiting scroll, the shaft being arranged to be driven by a motor so that during use rotation of the shaft imparts an orbiting motion to the orbiting scroll relative to a fixed scroll for pumping fluid between a pump inlet and pump outlet of the compressor, the fixed scroll having an opening through which the shaft extends and is connected to the orbiting scroll on an opposing side of the fixed scroll to the motor, a high vacuum region being located on an orbiting scroll side of the scroll arrangement and a low vacuum region being located generally on a fixed scroll side of the scroll arrangement, wherein a lubricant free anti-rotation device is located in the high vacuum region for resisting rotation of the orbiting scroll and allowing said orbiting motion, and a bearing arrangement for supporting rotation of the concentric shaft portion and eccentric shaft portion is located in the low vacuum region.

Other preferred and/or optional aspects of the invention are defined in the accompanying claims.

In order that the present invention may be well understood, an embodiment thereof, which is given by way of example only, will now be described with reference to the accompanying drawings, in which.

Figure 1:
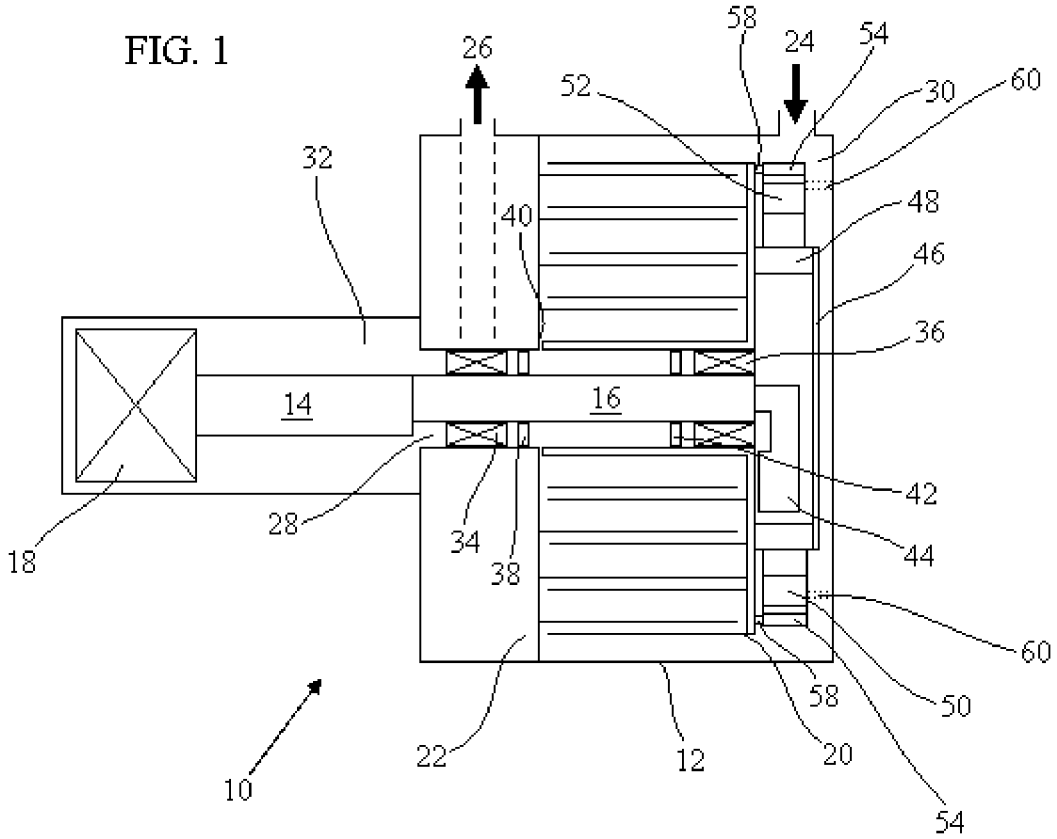
FIG. 1 shows schematically a scroll pump.
Figure 3:
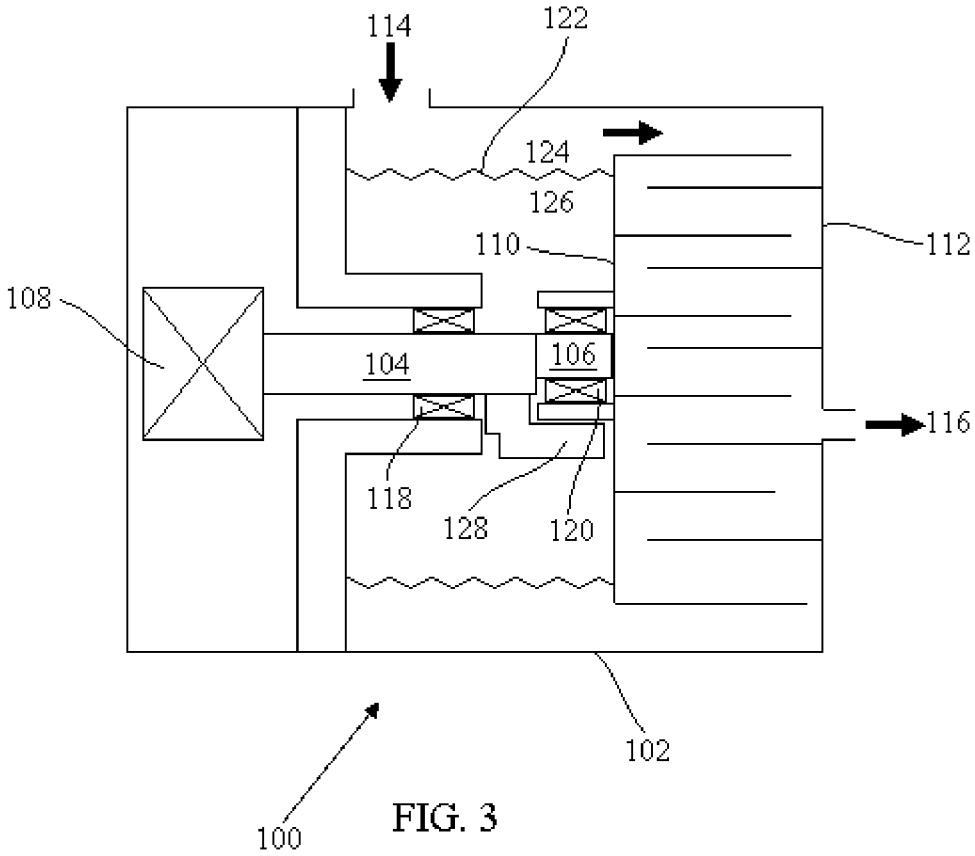
FIG. 3 shows a first prior art scroll pump.
Figure 4:
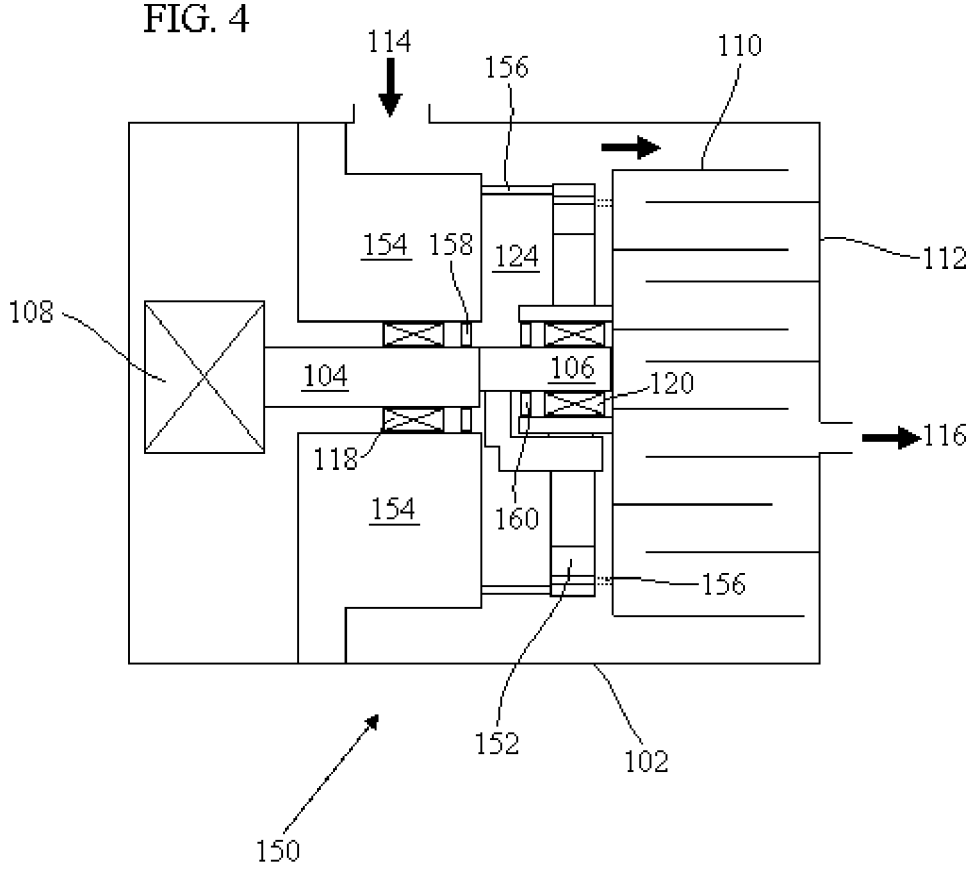
FIG. 4 shows a second prior art scroll pump.

A scroll compressor, or pump, 10 is shown in FIG. 1. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor. The fixed scroll is shown generally on the left and the orbiting scroll is shown generally on the right in FIG. 1. In this arrangement, the fixed scroll comprises an opening 28 through which the shaft 14, 16 extends and is connected to the orbiting scroll 20 on an opposing side of the fixed scroll to the motor 18. A high vacuum region 30 is located at the inlet 24 and a low vacuum, or atmospheric, region 32 is located at the outlet 26. In this way, the scroll arrangement is reversed compared to the arrangement shown in FIGS. 3 and 4.

A first bearing 34 supports the concentric portion of the drive shaft 14 for rotation. The bearing 34 is fixed relative to the housing or as shown the fixed scroll 22. A second bearing 36 connects the eccentric portion 16 of the drive shaft to the orbiting scroll 20 allowing angular movement of the orbiting scroll relative to the eccentric portion. A first shaft seal 38 resists the passage of lubricant from first bearing 34 towards an interface 40 between the orbiting scroll 20 and the fixed scroll 22 and a second shaft seal 42 resists the passage of lubricant from second bearing 36 to the interface. Since the bearing arrangement is now located in the low vacuum region a relatively small pressure differential exists across the bearing and therefore leakage can be effectively prevented by shaft seals 38, 42. Further, the lubricant free anti-rotation device can be located in the high vacuum region without risk of contamination. Although reverse scroll arrangement are known, the arrangements previously adopted lubricated devices which made the arrangements unsuitable for pumping in a clean environment.

A counter-weight 44 balances the weight of the orbiting components of the pump, including the orbiting scroll 20, the second bearing 36 and the eccentric portion 16 of the drive shaft. The orbiting scroll 20 constitutes the majority of the weight of the orbiting components and its centre of mass is located relatively close to the scroll plate of the orbiting scroll. A cap 46 is fixed to a raised seat 48 of the orbiting scroll and seals low vacuum region, containing the counter-weight and the bearings 34, 36 from the high vacuum region 30, which is typically at or close to atmosphere.

An anti-rotation device 50 is located in the high vacuum region 30 of the pump and is connected to the orbiting scroll 20 and the housing 12. The anti-rotation device resists rotation of the orbiting scroll but allows orbiting motion of the orbiting scroll. The anti-rotation device is lubricant free and in this example is made from a plastics material, and may be a one-piece polymer component.

Figure 2:
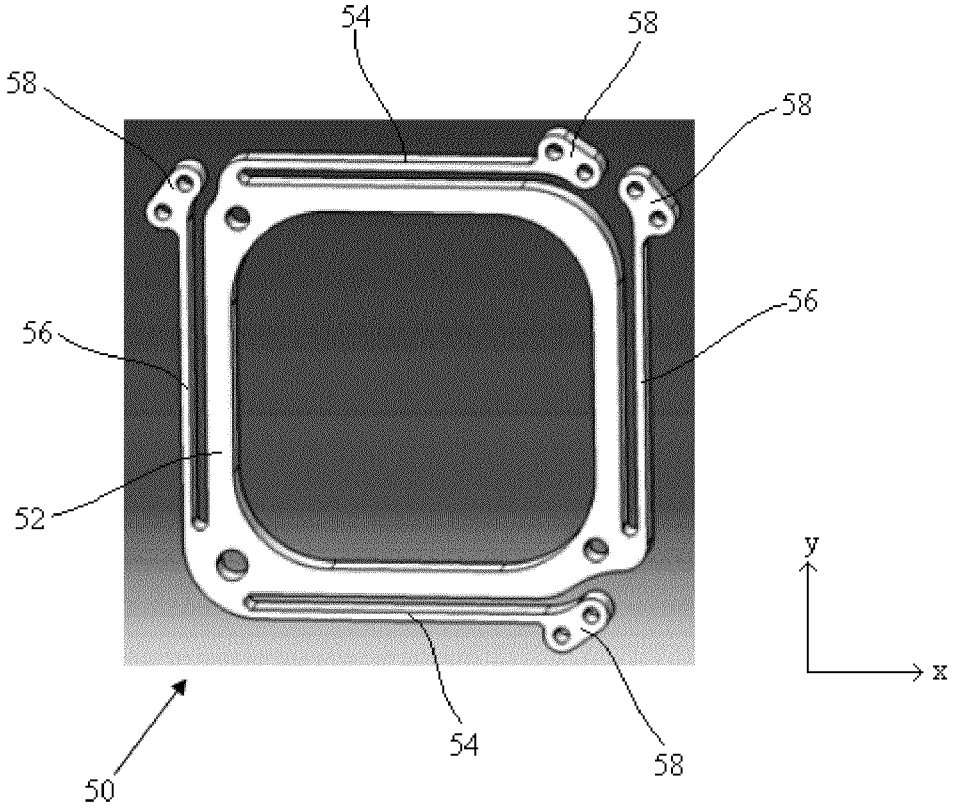
FIG. 2 shows an anti-rotation device of the scroll pump shown in FIG. 1.

The anti-rotation device 50 is shown in more detail in FIG. 2. The device comprises a central body portion 52 having a plurality of arms 54, 56 extending from the body. Each of the arms has a connecting portion 58 at an end thereof. The arms are arranged in two opposing pairs. One of the pairs 54, 56 is connected to the housing 12 and the other of the pairs is connected to the orbiting scroll 20. In FIG. 1, the first pair 54 is connected by fasteners 58 to the housing 12 and the second pair 56 is connected by fasteners 60 to the orbiting scroll. The second pair of arms 56 cannot be seen in FIG. 1 but the fasteners 60 are shown in broken lines. The arms 54 flex to allow movement of the orbiting scroll in the 'y' direction and the arms 56 flex to allow movement in the 'x' direction.

The anti-rotation device 50 is lubricant free and therefore can be located in the high vacuum region without contaminating the flow path through the scroll arrangement or causing the migration of lubricant upstream of the pump to a processing tool. The bearing 36 is located in the low vacuum region and therefore the pressure differential across the bearing and the shaft seal 42 is minimal thus reducing leakage of lubricant into the downstream portion of the flow path. The counterweight 44 is located adjacent the plate of the orbiting scroll and therefore close to the centre of mass in an axial direction. Accordingly, the eccentric shaft portion 16 may be reduced in diameter compared to known pumps and therefore the pump 10 is more compact.

The invention claimed is:

1. A scroll pump comprising:

a pump housing;

an orbiting scroll;

a fixed scroll;

a drive shaft comprising a concentric shaft portion and an eccentric shaft portion, wherein the eccentric shaft portion is connected to the orbiting scroll, wherein the drive shaft is arranged to be driven by a motor so that during use, rotation of the drive shaft imparts an orbiting motion to the orbiting scroll relative to the fixed scroll for pumping fluid between a pump inlet and a pump outlet of the scroll pump, wherein the fixed scroll forms an opening through which the drive shaft extends, and wherein the drive shaft is connected to the orbiting scroll on an opposing side of the fixed scroll to the motor, wherein, during operation, the scroll pump provides a high vacuum region between the pump inlet and the pump outlet, and wherein, during operation, the scroll pump provides a low vacuum region including the opening of the fixed scroll through which the drive shaft extends;

a lubricant free anti-rotation device, wherein the lubricant free anti-rotation device is located in the high vacuum region for resisting rotation of the orbiting scroll and allowing said orbiting motion;

a first bearing for supporting rotation of the concentric shaft portion;

a second bearing for supporting rotation of the eccentric shaft portion, wherein the first and the second bearings are located in the low vacuum region; and a counter-weight for balancing the weight of the orbiting components of the pump, wherein the counter-weight is located in the low vacuum region and adjacent to a scroll plate of the orbiting scroll.

2. The scroll pump of claim 1, wherein the anti-rotation device comprises a flexible plastics material.

3. The scroll pump of claim 1, wherein the anti-rotation device comprises:

a central body portion; and two pairs of opposing arms, wherein the two pairs of opposing arms extend from the central body, wherein a first pair is connected to the housing and a second pair is connected to the orbiting scroll, wherein the first pair flex to allow movement of the orbiting scroll relative to the housing in a first direction and the second pair flex to allow movement of the orbiting scroll relative to the housing in a second direction generally orthogonal to the first direction.

4. The scroll pump of claim 1, further comprising:

a first shaft seal that resists the passage of lubricant from the first bearing towards an interface of the orbiting scroll and the fixed scroll adjacent to the low vacuum region; and a second shaft seal that resists the passage of lubricant from the second bearing to the interface of the orbiting scroll and the fixed scroll.

5. The scroll pump of claim 4, wherein the first shaft seal is between the first bearing and the interface of the orbiting scroll and the fixed scroll, and wherein the second shaft seal is between the second bearing and the interface of the orbiting scroll and the fixed scroll.

6. The scroll pump of claim 1, wherein the orbiting scroll forms a cavity adjacent to the opening of the fixed scroll, wherein the second bearing is positioned within the cavity between the drive shaft and the orbiting scroll.

7. The scroll pump of claim 6, wherein the first bearing is positioned within the opening between the drive shaft and the fixed scroll.

8. The scroll pump of claim 7, further comprising:

a first shaft seal positioned within the opening between the drive shaft and the fixed scroll, wherein the first shaft seal resists the passage of lubricant from the first bearing towards an interface of the orbiting scroll and the fixed scroll adjacent to the low vacuum region; and a second shaft seal positioned within the cavity between the drive shaft and the orbiting scroll, wherein the second shaft seal resists the passage of lubricant from the second bearing to the interface of the orbiting scroll and the fixed scroll.

9. The scroll pump of claim 8, wherein the first shaft seal is between the first bearing and the interface of the orbiting scroll and the fixed scroll, and wherein the second shaft seal is between the second bearing and the interface of the orbiting scroll and the fixed scroll.

10. The scroll pump of claim 9, wherein the anti-rotation device comprises:

a central body portion; and two pairs of opposing arms, wherein the two pairs of opposing arms extend from the central body, wherein a first pair is connected to the housing and a second pair is connected to the orbiting scroll, wherein the first pair flex to allow movement of the orbiting scroll relative to the housing in a first direction and the second pair flex to allow movement of the orbiting scroll relative to the housing in a second direction generally orthogonal to the first direction.

11. A scroll pump comprising:

a pump housing;

an orbiting scroll;

a fixed scroll;

a drive shaft comprising a concentric shaft portion and an eccentric shaft portion, wherein the eccentric shaft portion is connected to the orbiting scroll, wherein the drive shaft is arranged to be driven by a motor so that during use, rotation of the drive shaft imparts an orbiting motion to the orbiting scroll relative to the fixed scroll for pumping fluid between a pump inlet and a pump outlet of the scroll pump, wherein the fixed scroll forms an opening through which the drive shaft extends, and wherein the drive shaft is connected to the orbiting scroll on an opposing side of the fixed scroll to the motor, wherein, during operation, the scroll pump provides a high vacuum region between the pump inlet and the pump outlet, and wherein, during operation, the scroll pump provides a low vacuum region including the opening of the fixed scroll through which the drive shaft extends;

an anti-rotation device, wherein the anti-rotation device is located in the high vacuum region for resisting rotation of the orbiting scroll and allowing said orbiting motion;

a first bearing for supporting rotation of the concentric shaft portion;

a second bearing for supporting rotation of the eccentric shaft portion, wherein the first and the second bearings are located in the low vacuum region; and a counter-weight for balancing the weight of the orbiting components of the pump, wherein the counter-weight is located in the low vacuum region and adjacent to a scroll plate of the orbiting scroll.

12. The scroll pump of claim 11, further comprising:

a first shaft seal that resists the passage of lubricant from the first bearing towards an interface of the orbiting scroll and the fixed scroll adjacent to the low vacuum region; and a second shaft seal that resists the passage of lubricant from the second bearing to the interface of the orbiting scroll and the fixed scroll.

13. The scroll pump of claim 12, wherein the first shaft seal is between the first bearing and the interface of the orbiting scroll and the fixed scroll, and wherein the second shaft seal is between the second bearing and the interface of the orbiting scroll and the fixed scroll.

14. The scroll pump of claim 11, wherein the orbiting scroll forms a cavity adjacent to the opening of the fixed scroll, wherein the second bearing is positioned within the cavity between the drive shaft and the orbiting scroll.

15. The scroll pump of claim 14, wherein the first bearing is positioned within the opening between the drive shaft and the fixed scroll.

16. The scroll pump of claim 15, further comprising:

a first shaft seal positioned within the opening between the drive shaft and the fixed scroll, wherein the first shaft seal resists the passage of lubricant from the first bearing towards an interface of the orbiting scroll and the fixed scroll adjacent to the low vacuum region; and a second shaft seal positioned within the cavity between the drive shaft and the orbiting scroll, wherein the second shaft seal resists the passage of lubricant from the second bearing to the interface of the orbiting scroll and the fixed scroll.

17. The scroll pump of claim 16, wherein the first shaft seal is between the first bearing and the interface of the orbiting scroll and the fixed scroll, and wherein the second shaft seal is between the second bearing and the interface of the orbiting scroll and the fixed scroll.

* * * * *